US007625303B2

(12) United States Patent
Simonds et al.

(10) Patent No.: US 7,625,303 B2
(45) Date of Patent: Dec. 1, 2009

(54) DIMPLES COMPOSED OF LETTERS OR SYMBOLS INSET INTO COVER

(75) Inventors: Vincent J. Simonds, Brimfield, MA (US); Thomas A. Veilleux, Charlton, MA (US)

(73) Assignee: Callaway Golf Company, Carlsbad, CA (US)

( * ) Notice: Subject to any disclaimer, the term of this patent is extended or adjusted under 35 U.S.C. 154(b) by 399 days.

(21) Appl. No.: 11/574,431

(22) PCT Filed: Apr. 6, 2006

(86) PCT No.: PCT/US2006/013297

§ 371 (c)(1), (2), (4) Date: Feb. 28, 2007

(87) PCT Pub. No.: WO2006/110643

PCT Pub. Date: Oct. 19, 2006

(65) Prior Publication Data

US 2009/0054177 A1 Feb. 26, 2009

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS 6,290,615 B1 * 9/2001 Ogg ..... 473/378
7,303,492 B2 * 12/2007 Aoyama et al. ..... 473/383
2003/0134697 A1 * 7/2003 Ogg ..... 473/383

OTHER PUBLICATIONS

Udo Machat and Larry Dennis, the Golf Ball Book, Sep. 2000, Sports Images, first edition, pp. 47, 54, 55, 67, 90.*

* cited by examiner

*Primary Examiner*—Raeann Trimiew
(74) *Attorney, Agent, or Firm*—Michael A. Catania; Elaine H. Lo

(57) ABSTRACT

The present invention relates to dimples and dimple patterns for golf balls (20), preferably dimple patterns composed of letters, symbols, logos and combinations thereof, inset into the cover of the golf ball (20). The golf ball (20) has dimples (40) and logo depressions (50) in a cover of the golf ball (20). The logo depressions (50) are preferably letters, symbols, logos and combinations thereof, inset into the cover of the golf ball (20).

4 Claims, 7 Drawing Sheets

DIMPLES COMPOSED OF LETTERS OR SYMBOLS INSET INTO COVER

TECHNICAL FIELD

The present invention relates to an aerodynamic surface geometry for a golf ball. More specifically, the present invention relates to an aerodynamic pattern for a golf ball comprising a plurality of dimples and at least one logo depression.

BACKGROUND ART

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better and more accurately than golf balls with brambles. A.G. Spalding & Bros., purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044, for a Golf Ball that discloses the use of protrusions to meet the 1.68 inch (42.67 mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378, for a Golf Ball With Uniform Land Configuration, discloses a golf ball with dimples that have triangular shapes. The total land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball And Method Of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. 406,623, has all elongated dimples.

A variation on this theme is set forth in Moriyama et al., U.S. Pat. No. 5,722,903, for a Golf Ball, which discloses a golf ball with traditional dimples and oval-shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076, for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377, for a Golf Ball, discloses circular and non-circular dimples. The non-circular dimples are square, regular octagonal and regular hexagonal. The non-circular dimples amount to at least forty percent of the 332 dimples on the golf ball. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Ogg, U.S. Pat. No. 6,290,615 for a Golf Ball Having A Tubular Lattice Pattern discloses a golf ball with a non-dimple aerodynamic pattern.

The HX® RED golf ball and the HX® BLUE golf ball from Callaway Golf Company of Carlsbad, Calif. are golf balls with non-dimple aerodynamic patterns. The aerodynamic patterns generally consist of a tubular lattice network that defines hexagons and pentagons on the surface of the golf ball. Each hexagon is generally defined by thirteen facets, six of the facets being shared facets and seven of the facets been internal facets.

Golf balls are now being produced having various dimple patterns, dimple sizes, and geometric dimple patterns. Generally speaking, all of these dimples are configured so as to have a substantially constant geometric surface. Whether circular or multi-sided, the dimples are designed so that the geometrical configuration of each dimple is substantially the same regardless of its size. In this type of dimple arrangement, the dimples are normally configured in some pattern such as an octahedron, dodecahedron, or the like, or are configured so as to provide sections within the hemisphere, whether those sections number four, or six, or whatever desired configuration. Normally, the dimples are arranged in a desired pattern within each section and then this pattern is repeated for each section. The standard procedure is that each hemisphere has the same number of dimples and in substantially the same pattern and the hemispheres may be rotated with respect to each other depending upon the position of the mold halves.

U.S. Pat. No. 5,356,150 issued Oct. 18, 1994 and assigned to the assignee of the present invention discloses a golf ball having a plurality of dimples formed on the spherical surface of the golf ball, with the surface defining opposite poles and an equator midway between the poles so as to divide the surface into two hemispheres. The hemispheres have substantially the same dimple pattern and each dimple pattern comprises a dimple-free area surrounding the pole, a dimple-free area adjacent the equator, and a plurality of substantially identical sections extending between the pole and the equator, with each of said sections having a dimple pattern which comprises a plurality of elongated dimples. The axis of each dimple may extend in a direction between a line parallel with the equator and a line between the equator and the pole. The majority of the dimples overlap at least one adjacent dimple. The method used for obtaining this pattern is to locate a plurality of substantially similar geometric dimples on each of the hemispheres and move the outline of the dimples tangentially along the surface of the ball in the selected direction until it passes beyond the spherical surface so as to form elongated dimples in the surface of the ball.

U.S. Pat. No. 5,890,975 which is also assigned to the assignee of the present invention discloses an improvement over the '150 patent and uses at least two different sizes of elongated dimples with substantially no dimple overlap.

SUMMARY OF THE INVENTION

According to a primary object of the invention, dimples may be formed by drilling or machining desired letters or symbols into a mold using the direct cavity machining process. This produces a letter, symbol or other shape that would have a size similar to the size of a traditional dimple, normally 0.1 to 0.25 inches high. When produced on a golf ball, the dimples would have a depth similar to that of a traditional circular or non-circular dimple, normally 0.005 to 0.015 inches. The dimple pattern would be optimized to optimize the aerodynamics of the finished golf ball.

BEST MODE(S) FOR CARRYING OUT THE INVENTION

Figure 1:
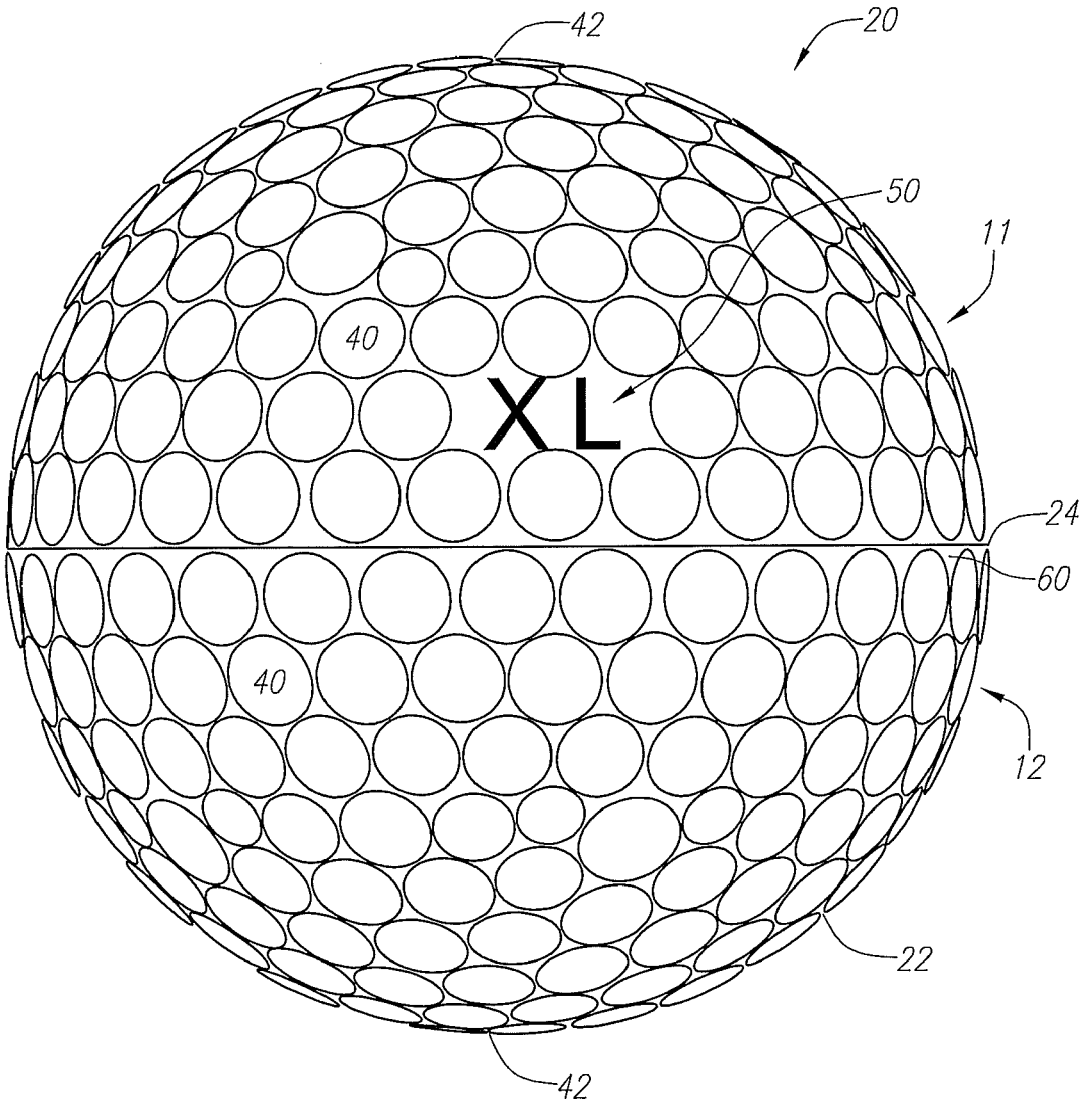
FIG. 1 is a perspective equatorial view of a golf ball showing a dimple pattern section of the invention that has letters interspersed with traditional dimples with a dimple between the letters.

As shown in FIGS. 1-5, a golf ball is generally designated 20. The golf ball 20 may be a two-piece golf ball, a three-piece golf ball, or a greater multi-layer golf ball. The golf ball 20 may be wound or solid. The golf ball 20 is preferably constructed as set forth in U.S. Pat. No. 6,855,073 which pertinent parts are hereby incorporated by reference. Alternatively, the golf ball is constructed as set forth in U.S. Pat. No. 6,117,024, which pertinent parts are hereby incorporated by reference. Additionally, the core of the golf ball 20 may be solid, hollow, or filled with a fluid, such as a gas or liquid, or have a metal mantle. The cover of the golf ball 20 may be any suitable material. A preferred cover for a three-piece golf ball is composed of a thermoset polyurethane material. Alternatively, the cover may be composed of a thermoplastic polyurethane, ionomer blend, ionomer rubber blend, ionomer and thermoplastic polyurethane blend, or like materials. A preferred cover material for a two-piece golf ball is a blend of ionomers. Those skilled in the pertinent art will recognize that other cover materials may be utilized without departing from the scope and spirit of the present invention. The golf ball 20 may preferably have a finish of one or more basecoats and/or one or more top coats.

The golf ball 20 preferably has a surface 22 that is formed from the cover. The surface 22 has an aerodynamic pattern comprising dimples 40, logo depressions 50 and land area 60. The golf ball has an equator 24 (shown by solid line) generally dividing the golf ball 20 into a first hemisphere 11 and a second hemisphere 12. A first pole dimple 42 is generally located ninety degrees along a longitudinal arc from the equator 24 in the first hemisphere 11. A second pole 42 is generally located ninety degrees along a longitudinal arc from the equator 24 in the second hemisphere 12.

In a preferred embodiment, the logo depression 50 and dimples 40 cover 70% to 90% of the surface area of the surface 22 of the golf ball 20. More preferably, the logo depression 50 and dimples 40 cover 78% to 85% of the surface area of the surface 22 of the golf ball 20. In a preferred embodiment, the land area 60 covers 10% to 30% of the surface 22 of the golf ball 20. Most preferably, the land area 60 covers 15% to 22% of the surface 22 of the golf ball 20. Preferably the land area 60 ranges from 1.60 square inches to 2.00 square inches, more preferably from 1.70 square inches to 1.80 square inches, and most preferably 1.784 square inches.

In a preferred embodiment, the golf ball 20 has six sets of dimples 40 that each has a different diameter varying from 0.160 inch to 0.190 inch. The pole dimples 42, which are included in the plurality of dimples 40, preferably has the smallest diameter.

The golf ball 20 preferably has a dimple pattern such as disclosed in any of the following U.S. patents, all of which are hereby incorporated by reference in their entirety: U.S. Pat. Nos. 5,356,150; 5,890,975; and 6,213,898.

FIG. 1 shows one example wherein logo depressions 50 are formed as letters inset into the cover. The logo depression 50 is preferably a graphic representation, company symbol, trademark or readily recognized abbreviation. The ball is divided into two hemispheres 11 and 12 divided by an equator E-E. A basic pattern section is shown on hemisphere 11. The pattern shows dimples 40 and the letter "X" and the letter "L" for the logo depression 50. This pattern can be repeated as often as desired in either or both hemispheres.

Figure 2:
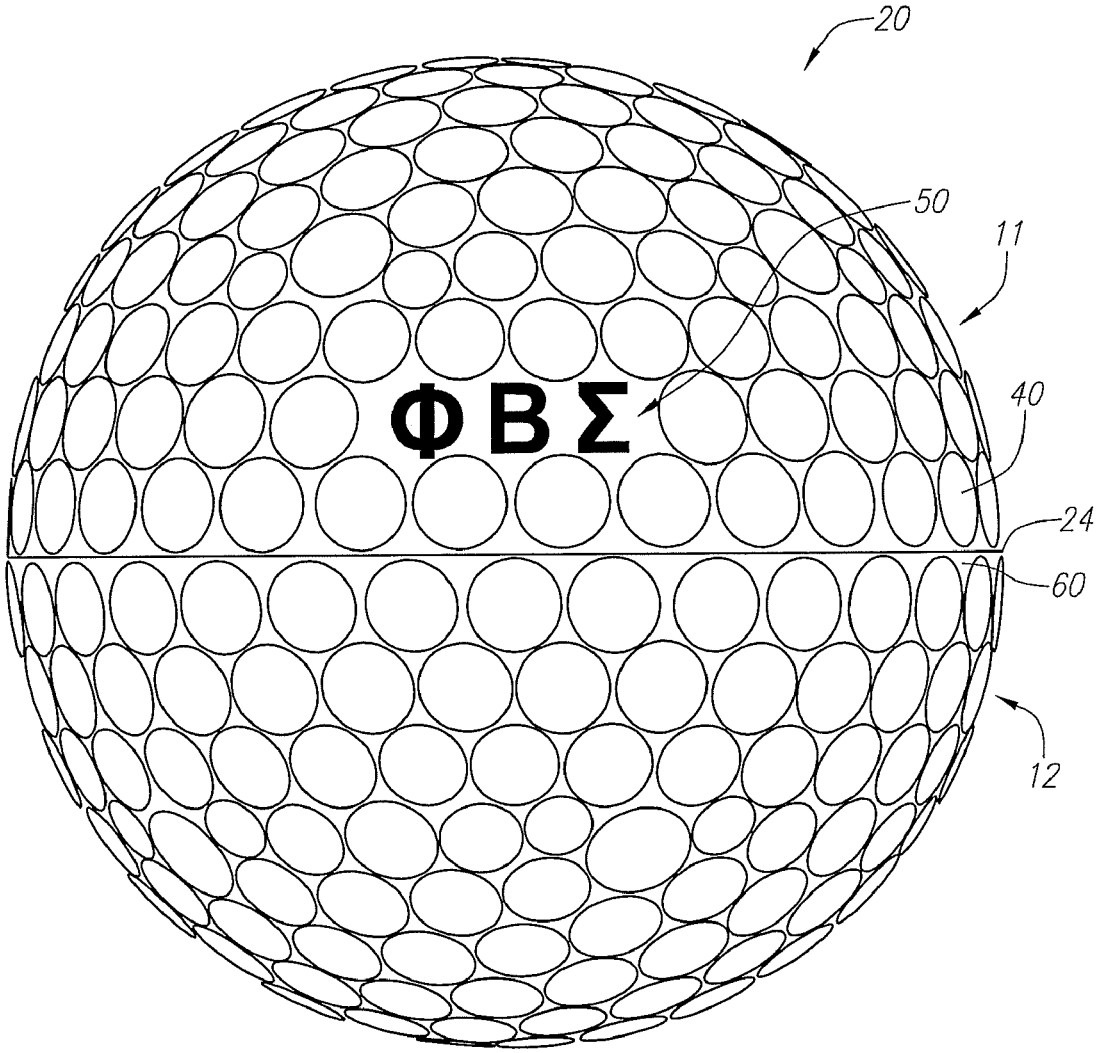
FIG. 2 is a perspective equatorial view of a golf ball showing a dimple pattern section of the invention that has different letters interspersed with traditional dimples.

FIG. 2 shows a second example wherein logo depressions 50 are formed as Greek letters inset into the cover. The ball is again divided into two hemispheres 11 and 12 divided by an equator E-E. A basic pattern section is shown on hemisphere 11. The pattern shows dimples 40 and the Greek letter "Φ", the Greek letter "B" and the Greek letter "Σ" for the logo depression 50. This pattern can be repeated as often as desired in either or both hemispheres, and any combination of letters can be used.

Figure 3:
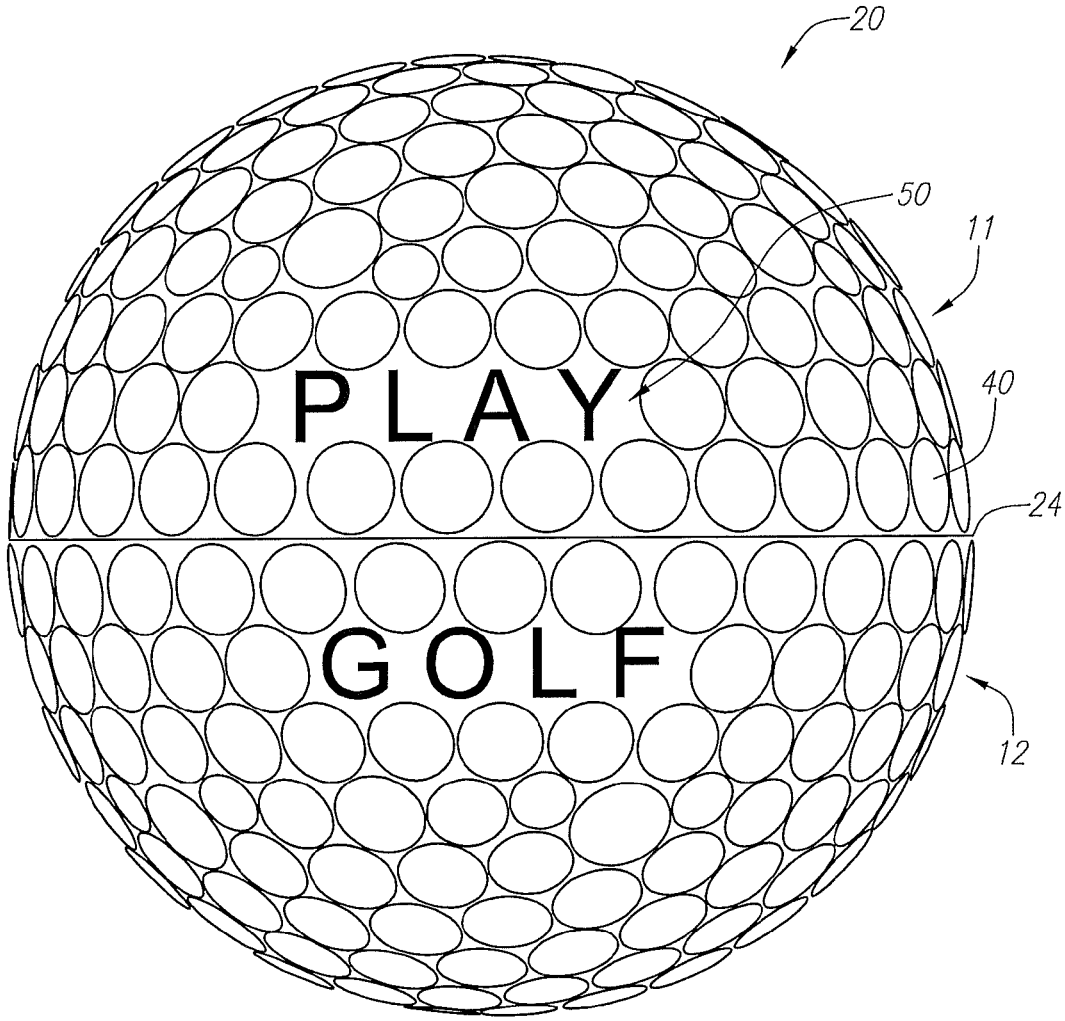
FIG. 3 is a perspective equatorial view of a golf ball showing a dimple pattern section of the invention that has words or longer letter patterns interspersed with traditional dimples.

FIG. 3 shows a third example wherein logo depressions 50 are formed as letters inset into the cover. In one hemisphere, 12, a pattern where the letters form a word, "GOLF" is shown. In the other hemisphere, 11, the letters form a different word or phrase from that in hemisphere 12. Additional traditional dimples may also be included and interspersed as shown in hemisphere 11.

Figure 4:
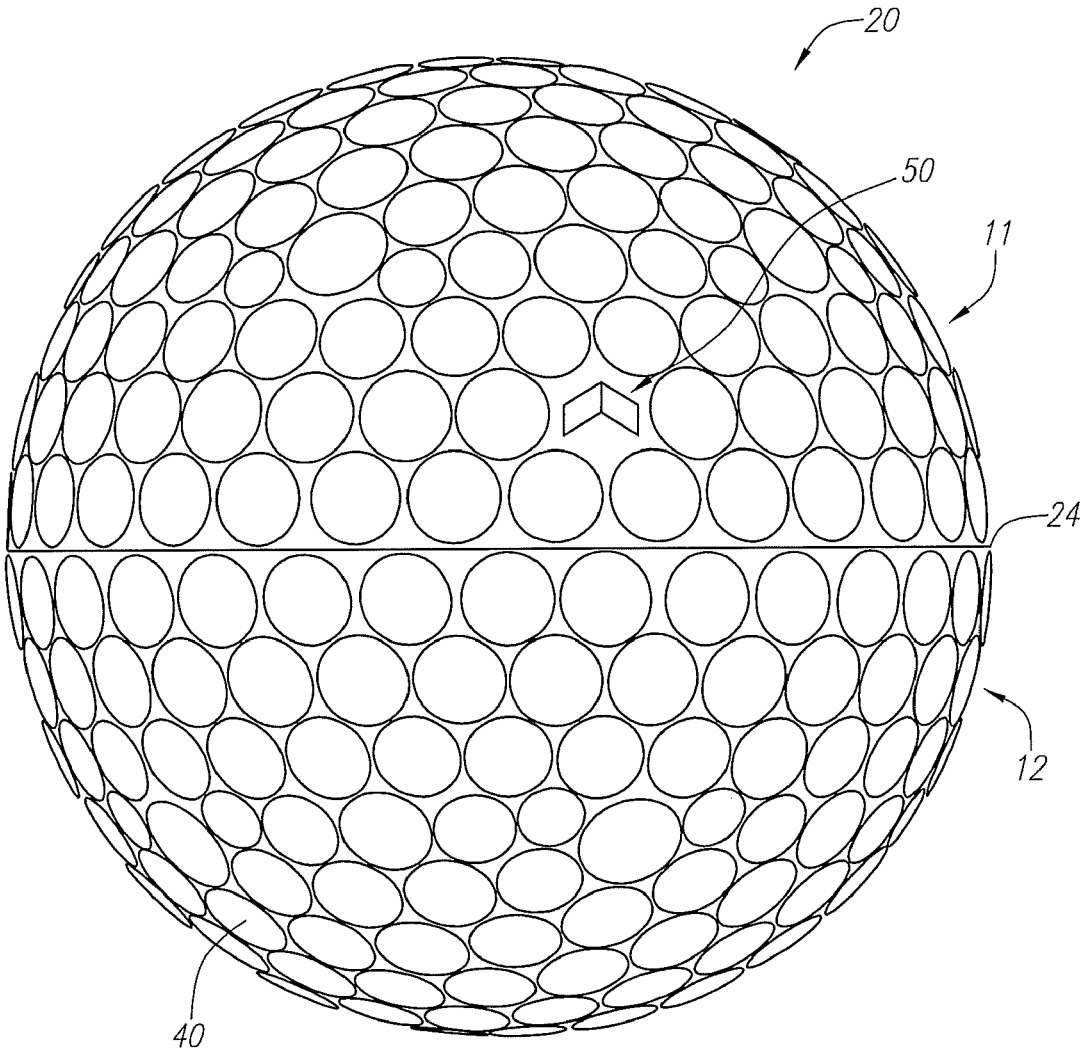
FIG. 4 is a perspective equatorial view of a golf ball showing a dimple pattern section of the invention that has a symbol or logo interspersed with traditional dimples.
Figure 5:
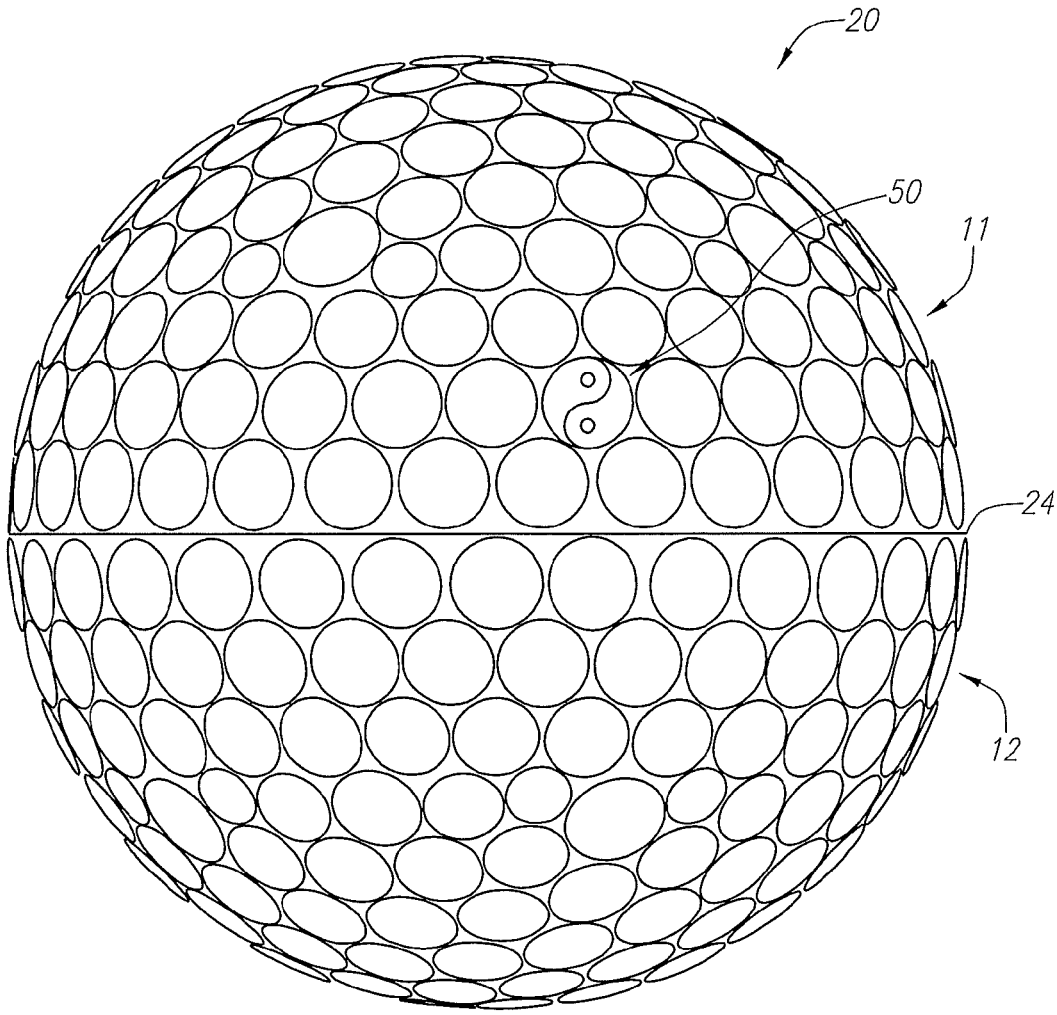
FIG. 5 is a perspective equatorial view of a golf ball showing a dimple pattern section of the invention that has a logo interspersed with traditional dimples.

FIG. 4 shows a forth example wherein a logo depression 50 is formed as a symbol inset into the cover. A basic pattern section is shown on hemisphere 11. The pattern shows dimples 40 and a logo depression 50, in this case a chevron.

Figure 6:
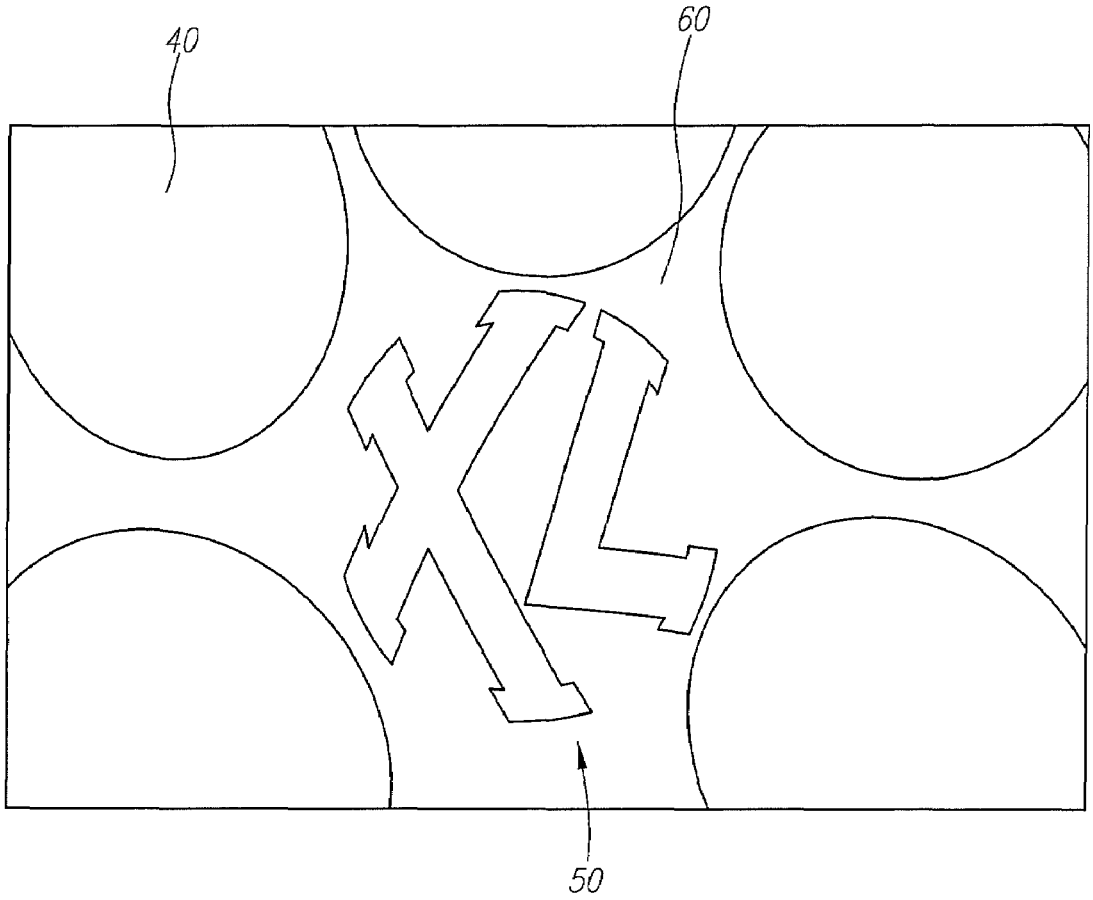
FIG. 6 is an isolated view of a logo depression.
Figure 7:
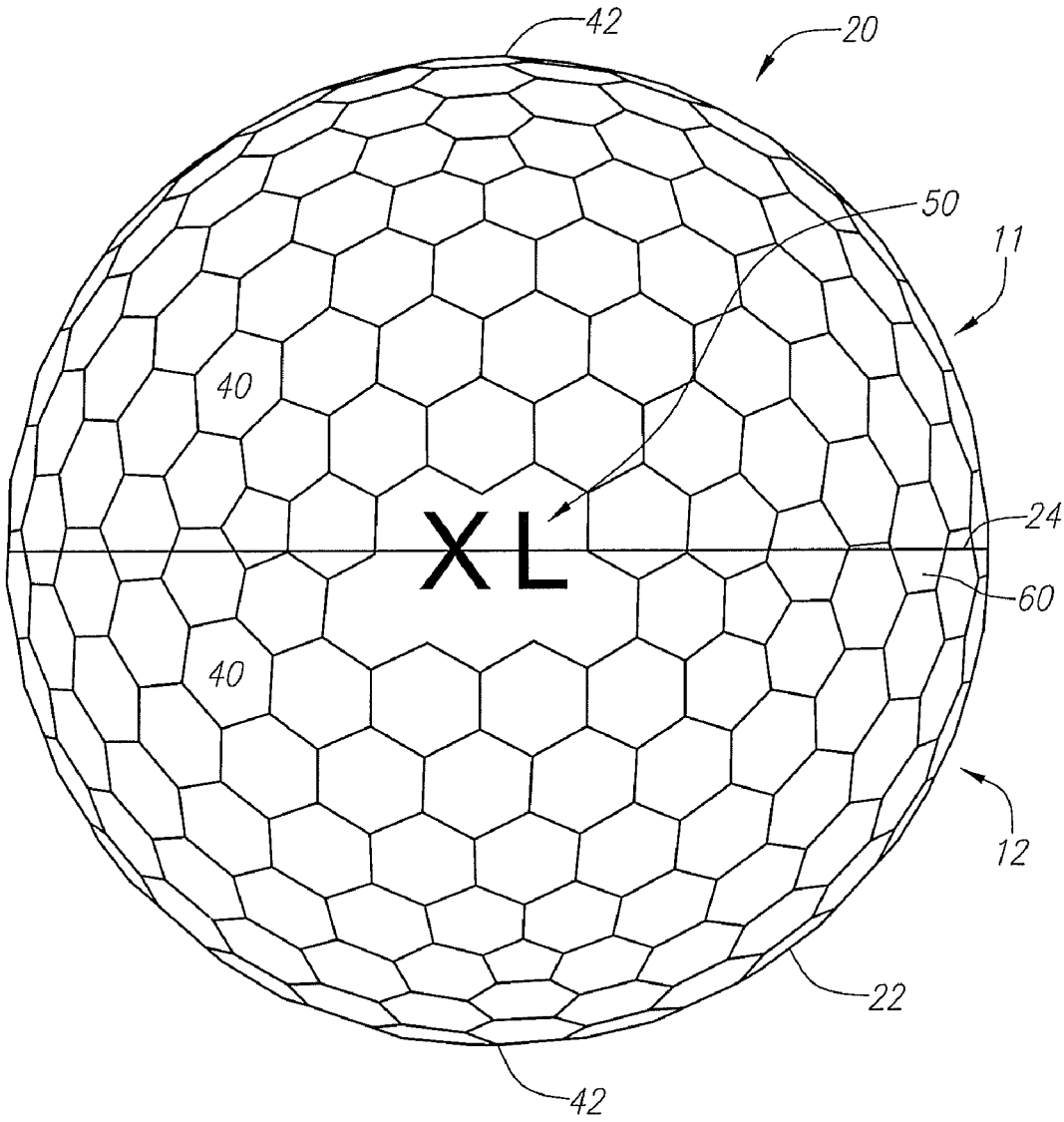
FIG. 7 is a perspective equatorial view of a golf ball showing an aerodynamic pattern that has a logo depression of letters.

FIG. 6 shows a fifth example wherein a logo depression 50 is formed as a symbol into the cover. The ball is divided into two hemispheres 11 and 12 divided by an equator E-E. A basic pattern section is shown on hemisphere 11. The pattern shows dimples 40 and a logo depression 50 which is the Ying/Yang symbol. This pattern can be repeated as often as desired in either or both hemispheres, and any desired combination of letters can be used.

The logo depressions 50 are formed by machining the various shapes into the molds. The logo depressions 50 are formed to be preferably the same size as traditional circular dimples, normally about 0.1 to 0.25 inches width and 0.005 to 0.015 inches depth. Alternatively, the logo depressions 50 are larger or smaller than traditional dimples, particularly if the desired effect is for the logo depressions 50 to stand out more than other dimples. The aerodynamics of the golf ball using the logo depressions 50 is similar to that of a more traditional dimple pattern.

Alternatively, an aerodynamic pattern based on a tubular lattice network, such as disclosed in U.S. Pat. Nos. 6,290,815; 6,958,020; and 6,979,272; which are all hereby incorporated by reference in their entirety, may be used with the logo depression 50. In this embodiment, the aerodynamic pattern is a plurality of multi-faceted polygons defined by a plurality of lattice members, each of the multi-faceted polygons having at least fourteen facets. The logo depression 50 is inset into the cover such as disclosed above.

The invention claimed is:

1. A golf ball comprising:

a core having a diameter ranging from 1.20 inches to 1.64 inches;

a cover having a thickness ranging from 0.015 inch to 0.075 inch, a surface of the cover comprising an aerodynamic pattern and at least one logo depression;

wherein the golf ball has a diameter ranging from 1.65 inches to 1.72 inches, wherein the aerodynamic pattern is a plurality of multi-faceted polygons defined by a plurality of lattice members, each of the multi-faceted polygons having at least fourteen facets.

2. The golf ball according to claim 1 wherein the at least one logo depression is the word GOLF.

3. The golf ball according to claim 1 wherein the at least one logo depression is a Greek language symbol.

4. The golf ball according to claim 1 wherein the at least one logo depression is an XL.

* * * * *